United States Patent [19]

Taraba, Jr.

[11] Patent Number: 4,736,558

[45] Date of Patent: Apr. 12, 1988

[54] BUILDING EXPANSION AND SEPARATION JOINT

[76] Inventor: Vernon J. Taraba, Jr., 2340 E. University Dr., Space 77, Tempe, Ariz. 85281

[21] Appl. No.: 912,140

[22] Filed: Sep. 24, 1986

Related U.S. Application Data

[63] Continuation of Ser. No. 673,652, Nov. 21, 1987, abandoned.

[51] Int. Cl.[4] ..... E04B 1/68

[52] U.S. Cl. ..... 52/309.8; 52/311; 52/396; 52/403; 428/160; 428/319.9

[58] Field of Search ..... 52/403, 393, 309.8, 52/309.9, 515, 396, 311, 315, 316; 404/47, 49, 64–68; 428/160, 319.9

[56] References Cited

U.S. PATENT DOCUMENTS

| | | | |
|---|---|---|---|
| 1,755,107 | 4/1930 | Fischer | 404/64 |
| 2,111,114 | 3/1938 | Fischer | 404/67 |
| 2,431,385 | 11/1947 | Fischer | 404/49 |
| 3,375,621 | 4/1968 | Curtis et al. . | |
| 3,375,763 | 4/1968 | Welch . | |
| 3,608,442 | 9/1971 | Berchou et al. | 404/65 |
| 3,680,270 | 8/1972 | DeMunck . | |
| 3,694,976 | 10/1972 | Warshaw | 52/403 X |
| 3,713,263 | 1/1973 | Mullen | 52/403 |
| 3,720,474 | 3/1973 | Stog et al. . | |
| 3,782,846 | 1/1974 | Johnson | 404/64 X |
| 3,822,428 | 7/1974 | Stog et al. . | |
| 3,844,876 | 10/1974 | Wilson et al. | 428/160 |
| 4,058,947 | 11/1977 | Earle et al. | 52/396 |
| 4,148,167 | 4/1979 | Puccio . | |
| 4,279,954 | 7/1981 | Johnard | 428/160 X |
| 4,346,542 | 8/1982 | Tateno | 52/396 |

FOREIGN PATENT DOCUMENTS

| | | |
|---|---|---|
| 1235974 | 3/1967 | Fed. Rep. of Germany . |
| 2007833 | 1/1970 | France . |
| 1051881 | 12/1966 | United Kingdom . |

*Primary Examiner*—Alfred C. Perham
*Assistant Examiner*—Richard E. Chilcot, Jr.
*Attorney, Agent, or Firm*—Charles E. Cates

[57] ABSTRACT

An expansion, or seismic joint, is provided of polyurethane/polyester sponge rubber having a series of parallel grooves in its front face and a single vee shaped groove in its rear face. The grooves in the front face include an elastomeric membrane of cured one-component polyurethane liquid rubber and a cured capping layer of aliphatic two-component urethane liquid rubber. The capping layer may be colored or if the capping layer is not used the elastomeric membrane may include an aggregate or sand coating. The capping layer may be colored.

7 Claims, 1 Drawing Sheet

BUILDING EXPANSION AND SEPARATION JOINT

This application is a continuation of application Ser. No. 06/673,652, filed Nov. 21, 1987, now abandoned.

BACKGROUND OF THE INVENTION

This invention relates to a building expansion and separation joint, also referred to as a seismic joint, and system and it is an object of the invention to provide an improved joint and system of this nature.

Materials for sealing space between structures, for example, such as buildings or the like, are known to the art. Reference is made to the U.S. Pat. No. 3,232,786 Kellman, Feb. 1, 1966 describing such material as a plastic foam sealing means. Such foam sealing means deteriorates with age and exposure to oxidizing environments and for this reason the foam of the U.S. Pat. No. 3,232,786 is coated with certain synthetic materials. In structures according to the Kellman patent the sealing material remains tacky and is worked into a joint by compressing the foam material so that upon expansion of the joint material the seal is maintained against the walls of the structure. The Kellman sealing means evidentally is not intended to be exposed to the atmosphere but rather is intended to be in an interior location where the tackiness of the material presents no problem.

SUMMARY OF THE INVENTION

It is a further object of the invention to provide a sealing joint material which overcomes the defects of the prior art.

The joint material contemplated by the invention envisions a strip of material that may be of standard length and formed of well known synthetic sponge rubber that may be compressed and forced into a joint where the exterior is exposed to the environment and to public view. In this instance the exposed surface of the joint material must be impervious to the effect of sunlight, particularly ultraviolet light, and any other oxidizing or deteriorating effects for a large number of years. Further,the exterior surface of the joint material must be capable of being colored to blend in with the building aesthetics and have a texture that is both appealing and serviceable.

Moreover the joint material, inasmuch as it is compressed when being forced into the joint or space between buildings, must have sufficient resiliency or springback so that it maintains itself against the surfaces of the joint, not only in the initial condition but under the condition wherein the joint has expanded by as much as 50% of the original unstressed dimensions. Of course the joint material must be able to sustain further compression. The exposed surface of the joint material must remain flat and not bulge or recess upon compression or expansion so that the exposed surface remains flat and remains consistent with the architectural appearance of the structure in which the joint is used. Furthermore the joint must be capable of being made from relatively inexpensive available synthetic materials, be capable of simple and easy manufacture and have long life both in the unused as well as the used state.

In carrying out the invention according to one form there is provided a flexible expansion joint device comprising an elongate strip of material having a body including a front face and a rear face, the body comprising a synthetic foam, the body being adapted to be compressed to at least fifty percent of its unstressed dimension in an expansion and compression direction, the front face of the body having a series of elongate grooves formed therein perpendicular to the expansion-compression direction, an impervious synthetic membrane on the surfaces of the grooves, a protective capping layer on the synthetic membrane, and an elongate central groove in the rear face of the body perpendicular to the expansion compression direction.

In carrying out the invention according to another form there is provided the flexible expansion joint device wherein the body comprises a soft polyester urethane foam of about two pounds per cubic foot density, said central groove comprises a substantially vee shape, the synthetic membrane comprises a cured polyurethane rubber, and the protective capping layer comprises an aliphatic urethane material.

According to still further form the invention comprises the flexible expansion joint device wherein the protective capping layer includes a sand aggregate, and pigmentation.

BRIEF DESCRIPTION OF THE DRAWINGS

For a better understanding of the invention reference should now be had to the accompanying drawing in which.

DESCRIPTION OF THE PREFERRED EMBODIMENT

Figure 1:
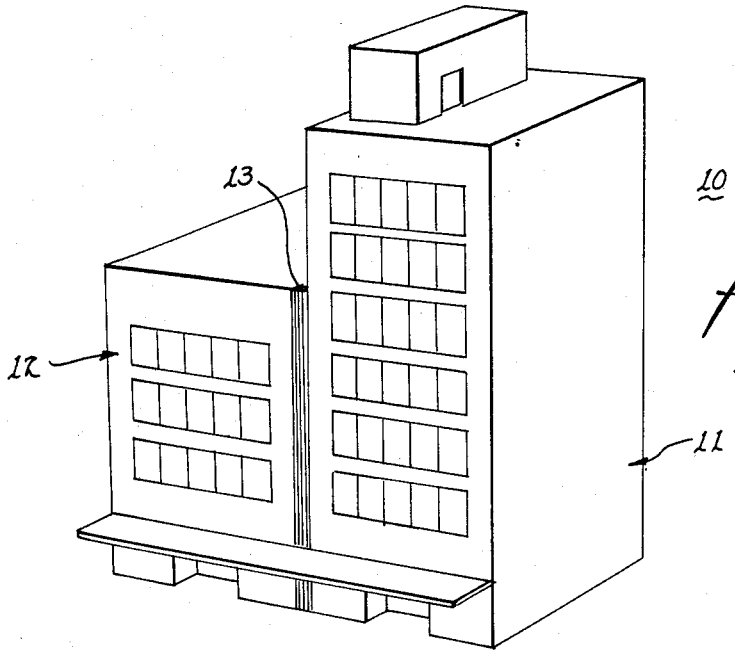
FIG. 1 is a somewhat diagrammatic representation of a building incorporating an expansion joint according to the invention.

Referring more particularly to the drawing, the invention is shown incorporated into a building 10 having two parts 11 and 12 separated by a sealing joint 13 according to the invention. It will be understood that the joint 13 is essentially diagrammatic in that in the drawing the dimensions of the joint are out of proportion transversely to that of the building parts themselves. In actual cases, for example, the transverse dimension of the sealing joint may be a few inches whereas the dimensions of the building may be many feet. It will also be understood that all buildings are not necessarily of dimensions such that different parts thereof require an expansion or contraction joint between them. Throughout this specification references to expansion joint etc. should be taken to include the concomitant expansion as will be understood. Clearly the invention has application only to those situations where such a joint is called for as understood by those skilled in this art.

The joint 13 comprises a body 14 of polyurethane/-polyester foam rubber, a polyurethane elastomeric membrane adhering member 15 and a capping layer 16.

The body 14 which may be essentially rectangular or square, for example, and of about 3 inches or so on a side includes a series of grooves or channels 17 running along the length of the front face of joint material, which, for example, may be about 6 feet in length, and a groove 18 at the rear face of the body 14 also running along the full length of the piece. The groove 18 while shown vee shaped as preferred, may be of any three or four sided shape, or have straight side walls, that is to say more or less rectangular shaped, or other shapes so long as the groove has the requisite width and depth.

For example, in an actual case, the width W of the body 14 was about two and five-eighths of an inch, the depth of the groove 18 was of the order of five-eighths of an inch, the width of the groove was of the order of one-half of an inch, and the depth D was of the order of two and three-quarters of an inch.

The body 14 when compressed about 40 to 50 percent of its unstressed dimension such as will be the case when it is disposed in a joint space, the groove 18 prevents the front face 19 from bulging either outwardly or curving inwardly as will be more particularly described. Concomitantly the rear face 21 also remains flat.

Figure 3:
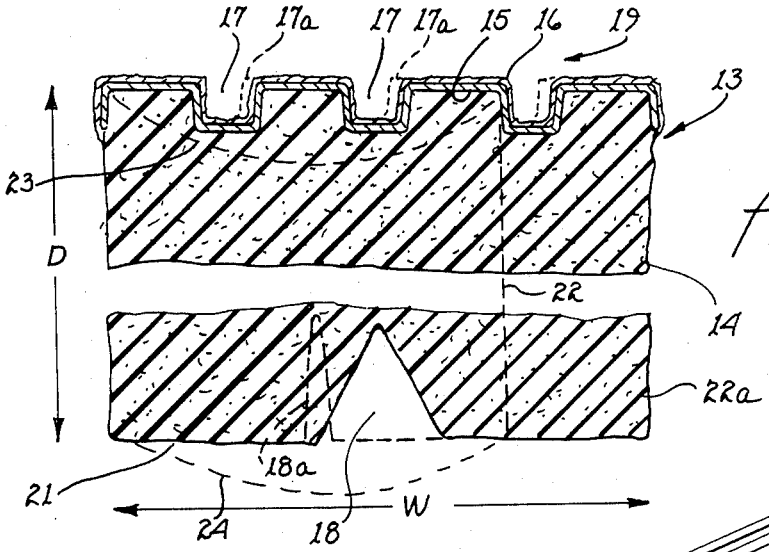
FIG. 3 is a sectional view taken substantially in the direction of the arrows 3—3 of FIG. 2.
Figure 2:
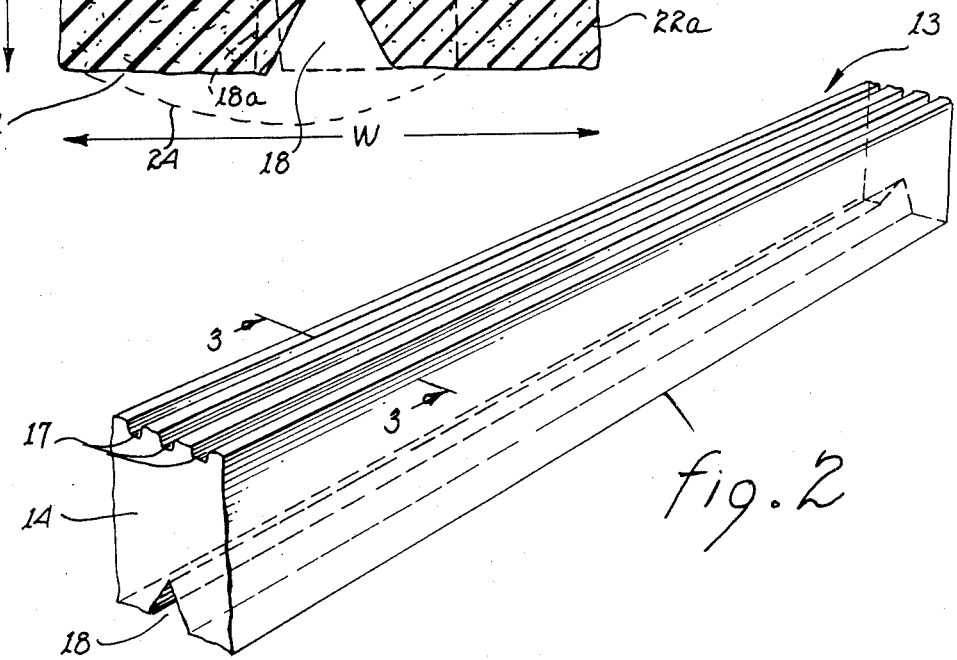
FIG. 2 is a perspective view of a section of joint material according to the invention.

In FIG. 3 a dotted line 22 is shown and represents the side 22*a* when the body 14 is compressed during use. Concave line 23 represents the front face 19 and convex line 24 represents the rear face 21 of the body when compressed and the invention is not incorporated. When the grooves 17 and the groove 18 are incorporated and the structure is compressed the face 19 contracts and the grooves 17 close a certain amount. Also the groove 18 closes a certain amount. The amounts of closing will vary depending on the degree of compression. In the actual case described the groove 18 closed to a narrow spike 18*a* and the sides of the grooves moved inwardly to about the dotted lines 17*a*.

However, the front face 19 remained essentially straight across, or flat and no wrinkles appeared. The rear face likewise remained flat.

The grooves or channels 17, extending inwardly from the front face 19 and may be of substantially less depth than the inwardly extending groove 18, prevent wrinkling of the front face when the body 14 is compressed. Accordingly the front face 19 in actual use of the joint material is free of any bulging, concavity or wrinkles. It remains flat during use and thus does not reveal the fact that an expansion or seismic joint exists at that location in the building structure. Particularly is this true when a colored capping material is disposed on the front face of the joint piece.

Typically the front face grooves, or channels, 17 may be more or less rectangular in shape and of about a quarter of an inch dimension on each side while the groove 18 inwardly from the back face as already described.

All dimensions given are exemplary and other dimensions may be used to achieve the purpose of the invention as will be understood by those skilled in the art. Similarly other shapes may be used. Depending upon the specific dimensions of the body 14 some trial and error steps may be necessary to determine the best specific dimensions of the grooves 17 and 18.

In the formation of the joint piece 13 the body 14 of polyurethane/polyester foam of the appropriate dimensions is first cut with the channels 17 and the groove 18 therein. The foam is characterized in the industry as being a combustion modified polyurethane/polyester foam UL Test 94, the foam having a density of about two pounds per cubic foot. It may be purchased as such. Over the front face 19 and the grooves 17 formed therein there is sprayed a layer of a one component polyurethane liquid rubber of about ten to fifteen mils in thickness. This layer is allowed to cure for several hours and provides a seal of all of the porosities of the foam rubber. Thereafter a second layer of a one component polyurethane liquid rubber is sprayed over the front face or surface 19 to cover all of the front face including the grooves. The second layer also is of about ten to fifteen mils in thickness and after curing forms a membrane with the first layer of about twenty to thirty mils in thickness. The curing of the two layers forming an elastomeric membrane 15 is of course essentially an air cure. The material of the membrane 15 may be purchased as such.

The capping layer 16 comprises an aliphatic polyurethane material called an aliphatic two component urethane liquid rubber and is sprayed on as is well understood. It may be purchased as such. This capping or topping material becomes tacky in about 15 minutes and cures in no more than 8 hours to a relatively hard shiny appearance. This aliphatic material comes in various colors and the color may be selected to match the architectural aspects of the building in which the sealing material is used. The modified urethane material when cured of the capping layer 16 is very durable and retains its color and resistance to exposure, even though exposed to the influence of ultraviolet rays and sun radiations.

A sand or aggregate type of finish may be applied to the front surface if desired but this is done in those instances when the aliphatic two component urethane liquid rubber is not used. This is to say the sand or aggregate coating is applied immediately after the second layer of the one component polyurethane liquid rubber 16 is applied. After the sand or aggregate has been applied the second layer of 16 is permitted to air cure as already described. The appearance of the sand exterior layer is of course essentially the color of sand and blends with certain types of building materials as will be understood.

Conveniently the pieces of joint material 13 may be six feet in length and the complete joint in a building 13 will consist of a sufficient number of six foot lengths. The end of the six foot pieces are spliced together using an appropriate form of seal material. After insertion of the sticks of joint material into the joint opening the vertical edges of the joint are caulked to the sides of the building by a suitable high grade polyurethane sealer and primer if necessary. After sealing of the ends of the six-foot lengths to each other and caulking the edges to the building the sealing system is completely, one hundred percent waterproof.

During installation, the body 14 with the layers 15 and 16 thereon is compressed forty to fifty percent of its dimension W in order to provide sufficient springback against the surfaces of the joint opening. Joints may be one to one and one-half inches wide or larger, if desired, and when the joint pieces are inserted into the joint space sharp tools or the like should not be used so as to avoid puncturing the membrane surface 15 or the capping layer 16. The appropriate width W may be supplied upon order of the person desiring to use it.

While a particular embodiment of the invention has been described it will be evident that other forms may be used and other materials likewise may be used within the scope of the disclosure, it being essential that the front face of the joint be free of wrinkles, bulges, or concavities.

I claim:

1. A flexible architectural expansion joint device comprising an elongate strip of material having a body including a front face and a rear face, said body comprising a synthetic foam free of internal stiffness supports, said body being adapted to be compressed to at least fifty percent of its unstressed dimension in an expansion and compression direction, the front face of said body having a series of elongate grooves formed therein perpendicular to said expansion-compression direction, an impervious synthetic membrane of about 20 to 30 mils in thickness on the surfaces of said grooves, a protective capping layer on said synthetic membrane, and an elongate central groove in the rear face of said body perpendicular to said expansion-compression direction.

2. The flexible architectural expansion joint device according to claim 1 wherein said body comprises a soft polyester urethane foam of about two pounds per cubic foot density and said central groove comprises a substantially vee shape.

3. The flexible architectural expansion joint device according to claim 2 wherein said first cured synthetic membrane comprises a cured polyurethane rubber.

4. The flexible architectural expansion joint device according to claim 3 wherein said protective cured capping layer comprises an aliphatic urethane material.

5. The flexible architectural expansion joint device according to claim 3 wherein said protective cured capping layer includes a sand aggregate.

6. The flexible architectural expansion joint device according to claim 4 wherein said capping layer includes pigmentation.

7. The flexible expansion joint device according to claim 5 wherein said capping layer includes pigmentation.

* * * * *

UNITED STATES PATENT AND TRADEMARK OFFICE

CERTIFICATE OF CORRECTION

PATENT NO. : 4,736,558

DATED : April 12, 1988

INVENTOR(S) : Vernon J. Taraba, Jr.

It is certified that error appears in the above-identified patent and that said Letters Patent is hereby corrected as shown below:

On the Title Page, Item [63] "1987" should read -- 1984 --.

Signed and Sealed this

Fifteenth Day of November, 1988

*Attest:*

*Attesting Officer*

DONALD J. QUIGG

*Commissioner of Patents and Trademarks*